US011201419B2

(12) United States Patent
Hung

(10) Patent No.: US 11,201,419 B2
(45) Date of Patent: Dec. 14, 2021

(54) ELECTRICAL CONNECTOR

(71) Applicant: Dongguan Luxshare Technologies Co., Ltd, Dongguan (CN)

(72) Inventor: Yung-Chih Hung, Taipei (TW)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/002,405

(22) Filed: Aug. 25, 2020

(65) Prior Publication Data

US 2021/0313717 A1 Oct. 7, 2021

(30) Foreign Application Priority Data

Apr. 7, 2020 (TW) ..... 109111669

(51) Int. Cl.
*H01R 12/51* (2011.01)
*H01R 13/11* (2006.01)
*H01R 13/50* (2006.01)

(52) U.S. Cl.
CPC ..... *H01R 12/51* (2013.01); *H01R 13/11* (2013.01); *H01R 13/50* (2013.01)

(58) Field of Classification Search
CPC .. H01R 12/724; H01R 13/113; H01R 13/187; H01R 12/7088; H01R 13/18; H01R 13/11; H01R 13/41; H01R 13/432; H01R 2103/00; H01R 24/62; H01R 13/112; H01R 13/26; H01R 2107/00; H01R 2201/26; H01R 43/16; H01R 4/023; H01R 4/185
See application file for complete search history.

(56) References Cited

U.S. PATENT DOCUMENTS 9,742,133 B1 * 8/2017 Chen ..... H01R 12/7088
10,096,920 B2 * 10/2018 Lee ..... H01R 12/722
10,290,965 B1 5/2019 Morello et al.
(Continued)

FOREIGN PATENT DOCUMENTS

CN 103579806 A 2/2014
CN 105514655 A 4/2016
CN 106299808 A 1/2017
(Continued)

*Primary Examiner* — Edwin A. Leon
*Assistant Examiner* — Matthew T Dzierzynski
(74) *Attorney, Agent, or Firm* — Birch, Stewart, Kolasch & Birch, LLP

(57) ABSTRACT

The present disclosure provides an electrical connector comprising an insulating body and at least one power terminal module. The insulating body comprises a receiving slot. The power terminal module is disposed in the receiving slot. Each power terminal module comprises a power terminal set and an elastic terminal. The power terminal set is disposed in the receiving slot. The power terminal set comprises a first power terminal, a second power terminal and an accommodating part which are overlappingly stacked. The second power terminal is closer than the first power terminal to the slot wall. The elastic terminal is disposed in the power terminal set, comprising a first end part, a second end part, and a plurality of elastic contacting parts. The plurality of elastic contacting parts is disposed between the first end part and the second end part. The first end part is disposed in the accommodating part.

16 Claims, 8 Drawing Sheets

(56) References Cited

U.S. PATENT DOCUMENTS 10,581,196 B2 * 3/2020 Liu ..... H01R 25/162

FOREIGN PATENT DOCUMENTS

| | | | |
|---|---|---|---|
| CN | 106571548 | A | 4/2017 |
| CN | 109510015 | A | 3/2019 |
| CN | 109742568 | A | 5/2019 |
| CN | 105762546 | B | 6/2019 |
| CN | 104183940 | B | 12/2019 |
| CN | 111564721 | A | 8/2020 |
| TW | I656701 | B | 4/2019 |

* cited by examiner

ELECTRICAL CONNECTOR

CROSS REFERENCE TO RELATED APPLICATION

This application claims the priority benefit of Taiwanese Patent Application Serial Number TW109111669, filed on Apr. 7, 2020, the full disclosure of which is incorporated herein by reference.

BACKGROUND

Technical Field

The present disclosure relates to the technical field of the electrical connector, particularly to an electrical connector having a power terminal set formed by overlapping of power terminal and elastic terminal.

Related Art

Electrical connectors connect two electronic devices or electronic components. In addition to transmitting data between two electronic devices or electronic components, electric power can also be transmitted. For some electrical connectors transmitting high-power electric power, power terminals are often provided for power transmitting. The electrical connector of the prior art is respectively provided with power terminals on opposite sides of the receiving slot of its insulating body for transmitting power after coupling. However, the power terminals are poorly contacted, which limits the power transmitted and dissatisfy situations requiring for high current.

SUMMARY

The embodiments of the present disclosure provide an electrical connector to solve the problem of the impossibility of high-current transmission.

The embodiments of the present disclosure provide an electrical connector comprising an insulating body and at least one power terminal module. The insulating body comprises a receiving slot. The power terminal module is disposed in the receiving slot. Each of the power terminal modules comprising a power terminal set and an elastic terminal. The power terminal set is disposed in the receiving slot. The power terminal set comprises a first power terminal, a second power terminal and an accommodating part which are overlappingly stacked. The second power terminal is closer than the first power terminal to the slot wall. The elastic terminal is disposed in the power terminal set, comprising a first end part, a second end part, and a plurality of elastic contacting parts. The plurality of elastic contacting parts is disposed between the first end part and the second end part. The first end part is disposed in the accommodating part.

In the embodiments of the present disclosure, the allowable value of current transmission can be increased by stacking the first power terminal with the second power terminal. Thus, the electrical connector of this disclosure could satisfy the requirement for high-current transmission. In addition, the elastic terminal disposed in the accommodating part could have a greater deformation tolerance to ensure that the elastic contacting part has good contact with the mating electrical connector. Thus, high-current transmission can be ensured.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
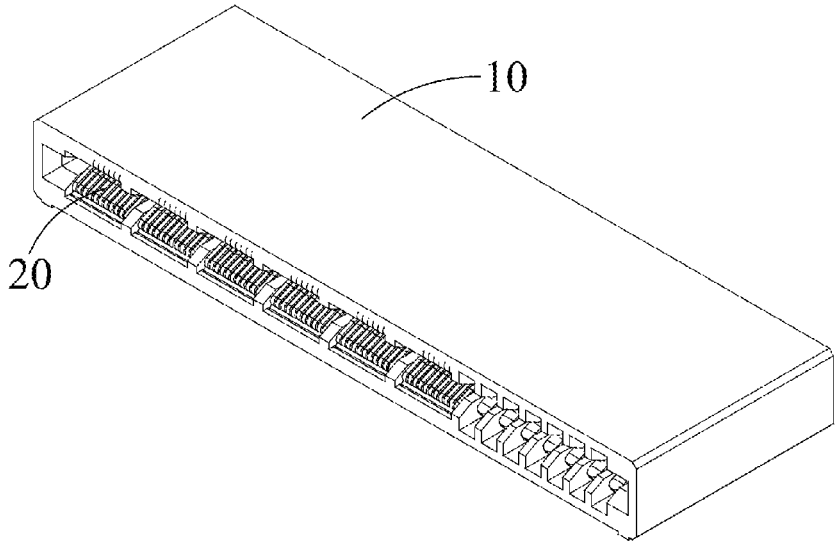
FIG. 1 is a perspective view of an electrical connector of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms “include/including” and “comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
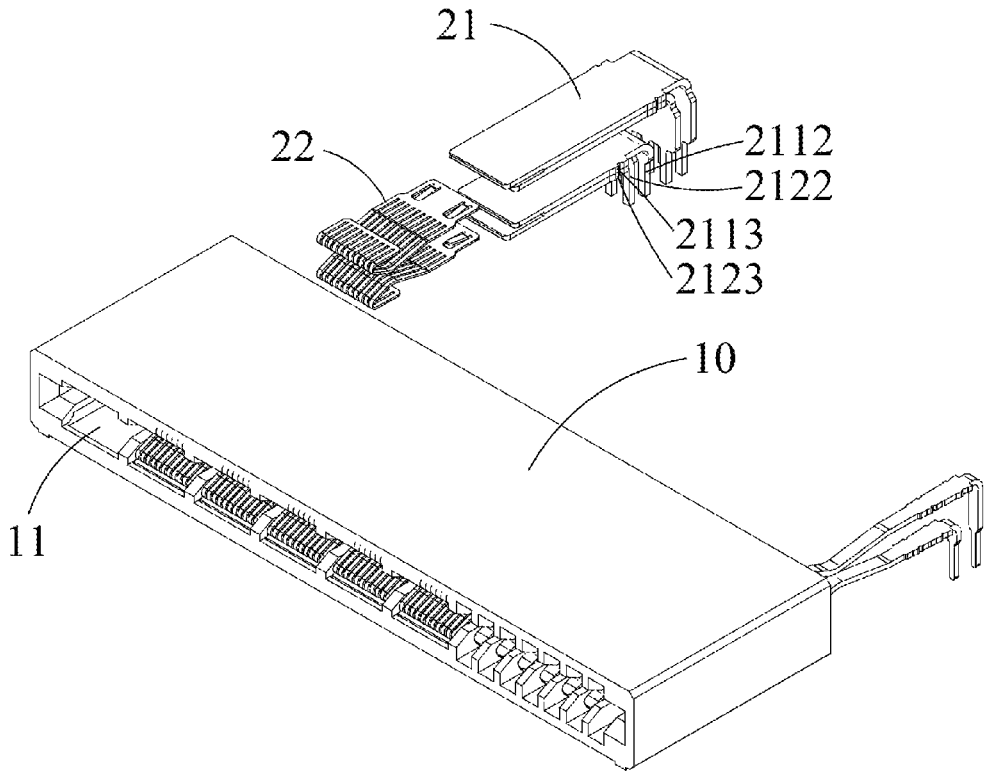
FIG. 2 is a partial exploded view of the electrical connector of the first embodiment of the present disclosure.
Figure 3:
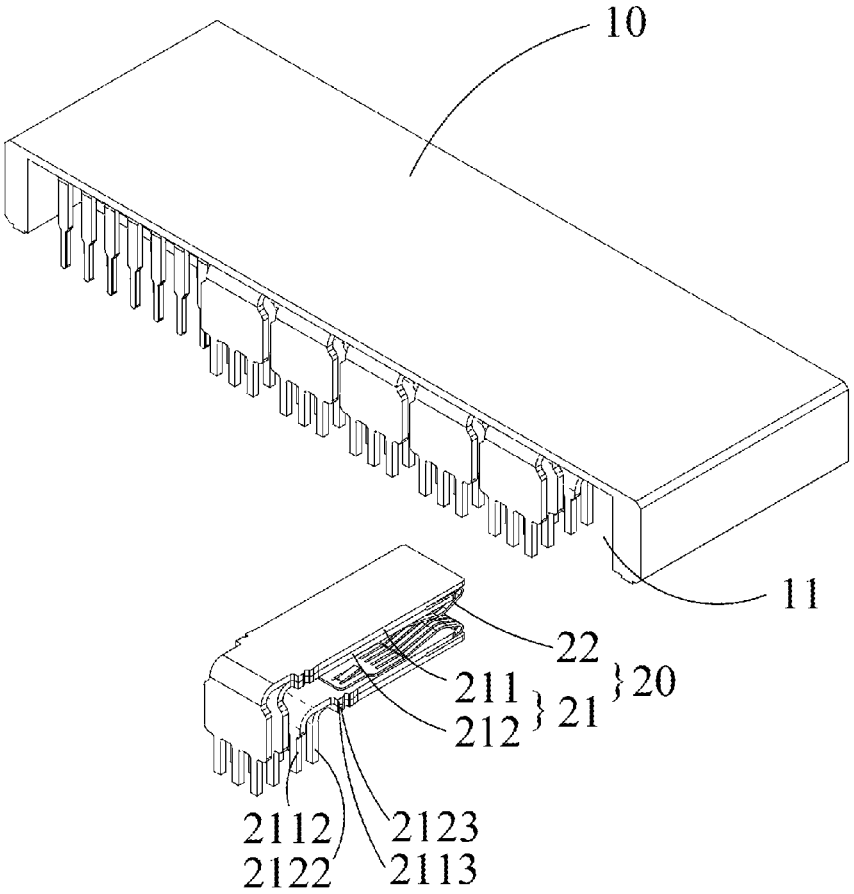
FIG. 3 is a partial exploded view in another angle of view of the electrical connector of the first embodiment of the present disclosure.
Figure 4:
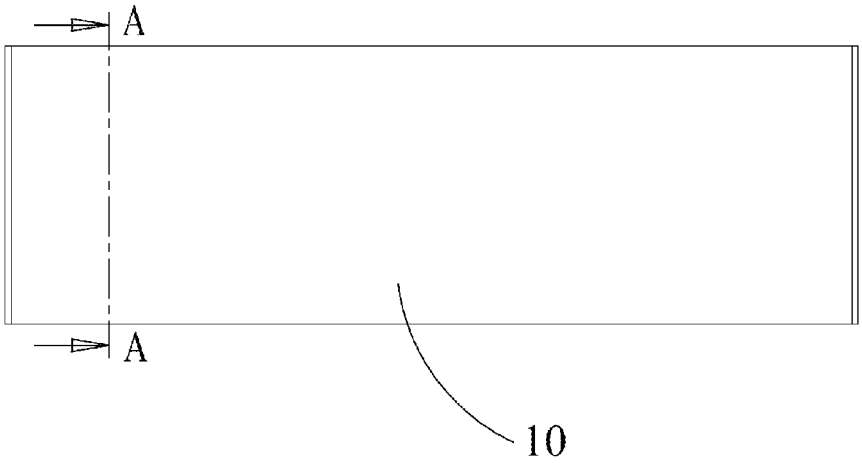
FIG. 4 is a top view of the electrical connector of the first embodiment of the present disclosure.
Figure 5:
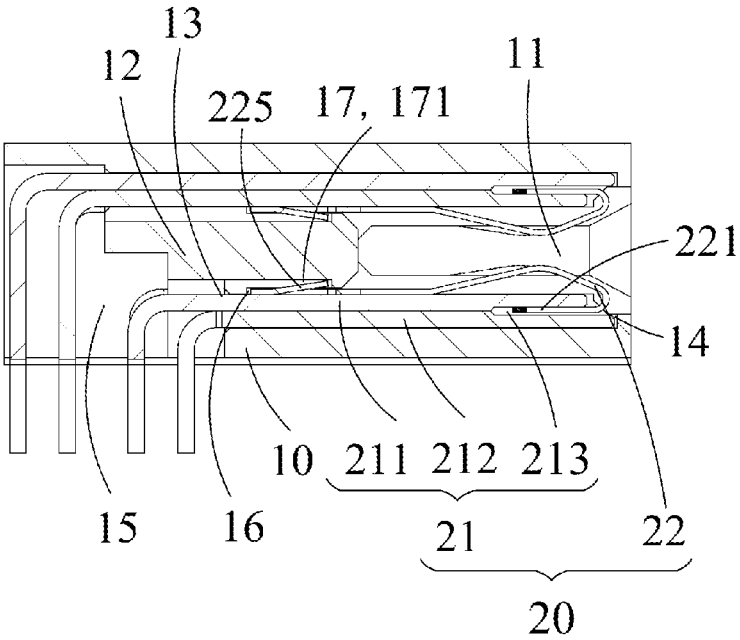
FIG. 5 is a cross-sectional view along line A-A of the electrical connector of FIG. 4.

FIG. 1 is a perspective view of an electrical connector of the first embodiment of the present disclosure. FIG. 2 is a partial exploded view of the electrical connector of the first embodiment of the present disclosure. FIG. 3 is a partial exploded view in another angle of view of the electrical connector of the first embodiment of the present disclosure. FIG. 4 is a top view of the electrical connector of the first embodiment of the present disclosure. FIG. 5 is a cross-sectional view along line A-A of the electrical connector of FIG. 4. As shown in the figure, the electrical connector in an embodiment of the present disclosure comprises an insulating body 10 and at least one power terminal module 20. The insulating body 10 can be produced by injection molding and made of insulating material, such as plastic, and comprises a receiving slot 11. As shown in FIG. 2 and FIG. 5, a tongue member 12 is disposed at the centerline of the receiving slot 11. When the mating electrical connector is inserted into the receiving slot 11, it can abut against the tongue member 12 to produce an effect of stopping. Positioning slots 13 are respectively provided between an upper wall surface of the tongue member 12 and a slot wall of the receiving slot 11 and between a lower wall surface of the tongue member 12 and a slot wall of the receiving slot 11. In addition, accommodating recesses 14 are provided on both an upper and a lower slot walls of the receiving slot 11. The positioning slot 13 communicates with the accommodating recess 14. An accommodating space 15 is formed at the backside of the insulating body 10. The accommodating space 15 communicates with the receiving slot 11 in front of the insulating body 10 through the positioning slot 13. The power terminal module 20 is disposed in the receiving slot 11, and is positioned in the positioning slot 13 and the accommodating recess 14. In this embodiment, the positioning grooves 13 and accommodating recesses 14 are provided on the upper and lower opposite wall surfaces of the receiving slot 11. Thus, the power terminal modules 20 can be respectively inserted into the receiving slot 11 on the opposite upper and lower wall surfaces of the receiving slot 11.

Each of the power terminal module 20 comprises a power terminal set 21 and an elastic terminal 22. The power terminal set 21 is disposed in the receiving slot 11. The power terminal set 21 comprises a first power terminal 211, a second power terminal 212 and an accommodating part 213. The first power terminal 211 and the second power terminal 212 are overlapping stacked. The second power terminal 212 is closer than the first power terminal 211 to the slot wall of the receiving slot 11. The first power terminal 211 is closer than the second power terminal 212 to the tongue member 12. As shown in FIG. 5, the first power terminal 211 is stacked with the second power terminal 212. The first power terminal 211 and second power terminal 212, which are overlappingly stacked, pass through the positioning slot 13 and are accommodated in the accommodating recess 14.

In this embodiment, the first power terminal 211 and the second power terminal 212 are flatten-shaped. The first power terminal 211 comprises a first body 2111 (FIG. 7) and a plurality of first weld legs 2112. The plurality of first weld legs 2112 extends from the first body 2111. The second power terminal 212 comprises a second body 2121 (FIG. 7) and a plurality of second weld legs 2122. The plurality of second weld legs 2122 extends from the second body 2121. The first weld leg 2112 can be used to weld the first power terminal 211 to a circuit board and electrically connected with a circuit of the circuit board. The second weld leg 2122 can be used to weld the second power terminal 212 to a circuit board and electrically connected with a circuit of the circuit board. In detail, in this embodiment, as shown in FIG. 2, both the first body 2111 and the second body 2121 are L-shaped plates. A front end of the second power terminal 212 (the front end refers to one end close to an opening of the receiving slot 11 when the second power terminal 212 is assembled to the insulating body 10) is closer than a front end of the first power terminal 212 (the front end refers to one end close to an opening of the receiving slot 11 when the first power terminal 211 is assembled to the insulating body 10) to an opening of the receiving slot 11 of the insulating body 10.

In addition, as shown in FIG. 2 and FIG. 3, the first body 2111 comprises a plurality of first barbs 2113 disposed on opposite two sides of the first body 2111. The second body 2121 comprises a plurality of second barbs 2123 disposed on opposite two sides of the second body 2121. The plurality of first barbs 2113 and the plurality of second barbs 2123 are interferingly fitted to the insulating body 10. In this embodiment, the first barb 2113 is disposed on opposite two sides of the first body 2111 in a direction perpendicular to the insertion direction of the receiving slot 11. Similarly, the second barb 2123 is disposed on opposite two sides of the second body 2121 in a direction perpendicular to the insertion direction of the receiving slot 11. The first barb 2113 and the second barb 2123 interfere with the insulating body 10, so the first power terminal 211 and the second power terminal 212 are fitted to the insulating body 10.

Figure 6:
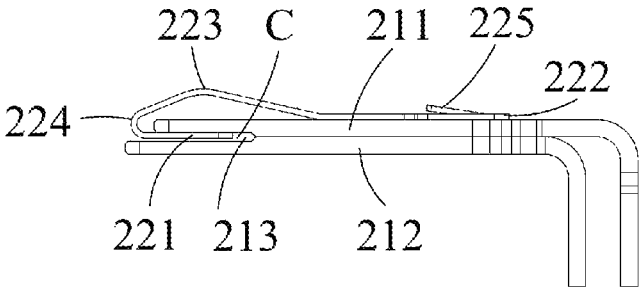
FIG. 6 is a side view of a power terminal module of the electrical connector of the first embodiment of the present disclosure.
Figure 7:
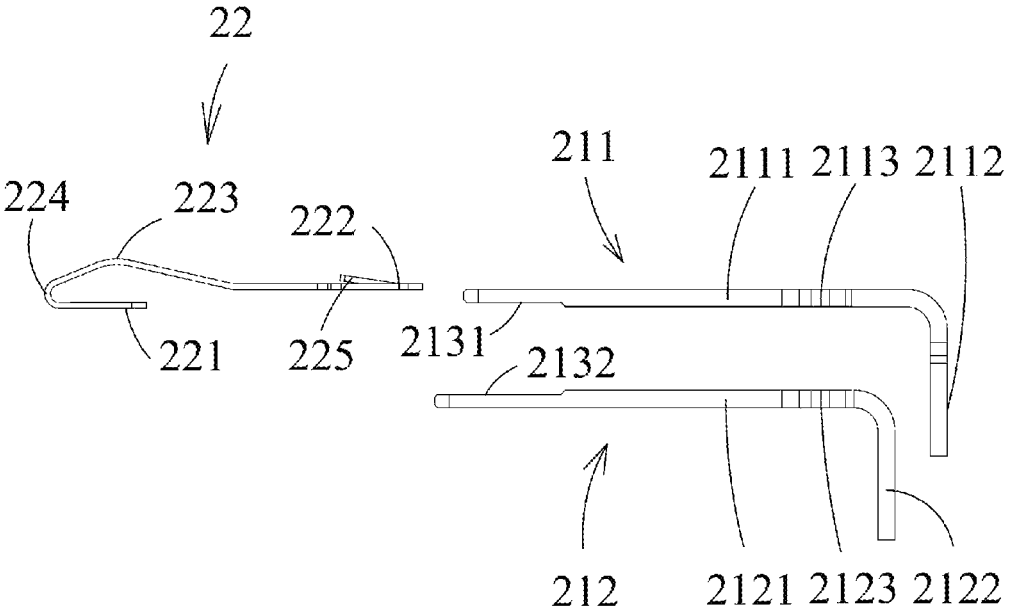
FIG. 7 is an exploded view of the power terminal module of FIG. 6.

FIG. 6 is a side view of a power terminal module of the electrical connector of the first embodiment of the present disclosure. FIG. 7 is an exploded view of the power terminal module of FIG. 6. As shown in the figures, the accommodating part 213 is disposed between the first power terminal 211 and the second power terminal 212. The accommodating part 213 comprises a first recess 2131 and a second recess 2132. The first recess 2131 is disposed on a surface of the first power terminal 211 opposite to the second power terminal 212. The second recess 2132 is disposed on a surface of the second power terminal 212 opposite to the first power terminal 211. When the first power terminal 211 stacks with the second power terminal 212, the first recess 2131 and the second recess 2132 are disposed opposite to each other to form an accommodating gap C.

Back to FIG. 5 and FIG. 6, the elastic terminal 22 is disposed in the power terminal set 21 and comprises a first end part 221, a second end part 222, and a plurality of elastic contacting parts 223. The plurality of elastic contacting parts 223 is disposed between the first end part 221 and the second end part 222. The first end part 221 is disposed in the accommodating part 213. That is, the first end part 221 is disposed in the accommodating gap C. In this embodiment, the elastic terminal 22 comprises a bent part 224. As described above, the first end part 221 is disposed in the accommodating part 213. The elastic terminal 22 is bent around the front end of the first power terminal 211 to form the bent part 224. One end of the bent part 224 is connected to the first end part 221, and the other end is connected to the plurality of elastic contacting parts 223. In this embodiment, each elastic contacting part 223 presents a protruding elastic tab shape, and protrudes in a direction away from the first power terminal 211, which is protruding in a direction facing the receiving slot 11. The elastic terminal 22 extends from one end of the elastic contacting part 223 along with the first power terminal 211 toward the positioning slot 13, accommodating slots 16 are formed on both an upper and a lower wall surfaces of the tongue member 12. The accommodating slot 16 is disposed adjacent to the positioning slot 13. The second end 222 of the elastic terminal 22 extends into the accommodating slot 16 through the front end of the tongue member 12 and is disposed in the accommodating slot 16.

In addition, positioning components 17 are further provided on the upper and lower wall surfaces of the tongue member 12. The positioning components 17 are disposed adjacent to the accommodating slot 16. The second end part 222 is accommodated in the accommodating slot 16 and is positioned in the positioning component 17. In this embodiment, the positioning component 17 comprises a positioning recess 171 disposed on the tongue member 12. A part of the second end 222 is limited to the positioning recess 171. In detail, the elastic terminal 22 comprises at least one elastic tab 225. In this embodiment, the elastic tab 225 is disposed on the second end part 232. The elastic tab 225 extends toward the receiving slot 11. The positioning recess 171 is disposed corresponding to the elastic tab 225. The elastic tab 225 abuts against a wall surface of the positioning recess 171. In this way, by abutting the elastic tab 225 of the elastic terminal 22 against a wall surface of the positioning recess 171 and by abutting the second end part 222 of the elastic terminal 22 against a slot wall of the accommodating slot 16, a limiting effect can be produced onto the elastic terminal 22 in a front and rear direction parallel to the insertion direction of the receiving slot 11. In addition, by surrounding the bent part 224 of the elastic terminal 22 around the front end of the first power terminal 211, a limiting effect can be produced in an up and down direction perpendicular to the insertion direction of the receiving slot 11.

In this embodiment, the first power terminal 211 and the second power terminal 212 are less flexible than the elastic terminal 22, which indicates that the elastic terminal 22 is easier to elastically deform than the first power terminal 211 and the second power terminal 212. When the mating electrical connectors are inserted into the receiving slot 11, the elastic contacting part 223 is compressed by the mating electrical connectors and deforms. In this way, the elastic contacting part 223 generates an elastic force to abut against a goldfinger of the mating circuit board. As shown in FIG. 1, a gap exists between two adjacent elastic contacting parts 223.

Figure 8:
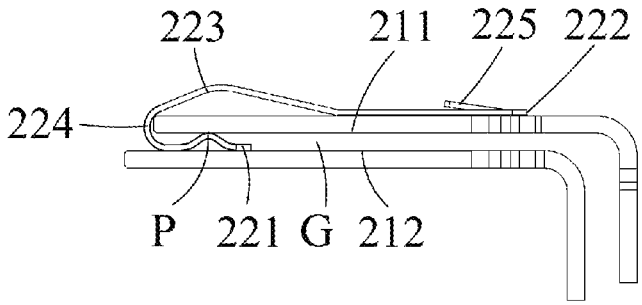
FIG. 8 is a side view of a power terminal module of the second embodiment of the present disclosure.

FIG. 8 is a side view of a power terminal module of the second embodiment of the present disclosure. Since the power terminal module of this embodiment is partially the same as the power terminal module of the first embodiment, the same symbols would be given to the same components and descriptions would be omitted. In this embodiment, between the first power terminal 211 and the second power terminal 212 existing an accommodating gap Gin which the first end part 221 of the elastic terminal 22 is disposed. In this embodiment, the first end part 221 of the elastic terminal 22 comprises an elastic abutting bump P abutting against the first power terminal 211. When the elastic abutting bump P is disposed in the accommodating gap G, the elastic abutting bump P is elastically deformed due to the limitation by the gap of the accommodation gap G, such that the elastic terminal 22 is pressed against the first power terminal 211 by the elastic force of the elastic abutting bump P. Thus, the elastic terminal 22 could perform a better effect of positioning.

Figure 9:
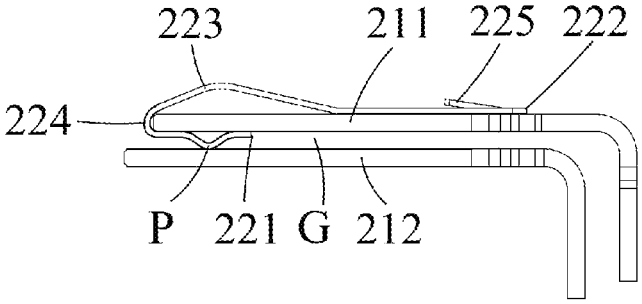
FIG. 9 is a side view of a power terminal module of the third embodiment of the present disclosure.

FIG. 9 is a side view of a power terminal module of the third embodiment of the present disclosure. Since the power terminal module of this embodiment is partially the same as the power terminal module of the second embodiment, the same symbols would be given to the same components and descriptions would be omitted. In this embodiment, the elastic abutting bump P abuts against the second power terminal 212. Since the rest parts of the embodiments is identical to the second embodiment, the related description would not be repeated herein.

Figure 10:
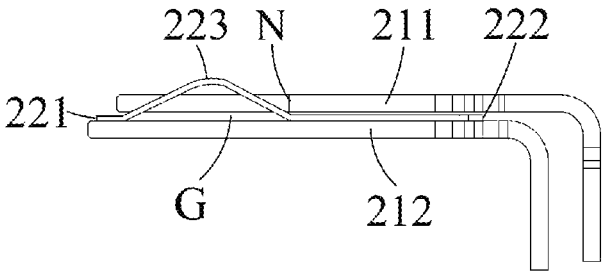
FIG. 10 is a side view of a power terminal module of the fourth embodiment of the present disclosure.
Figure 11:
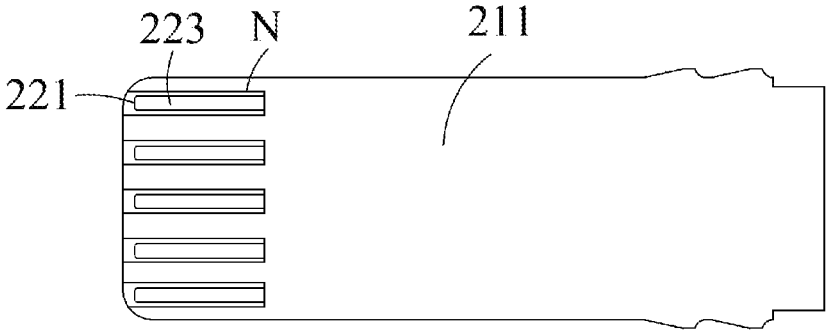
FIG. 11 is a top view of the power terminal module of the fourth embodiment of the present disclosure.

FIG. 10 and FIG. 11 are side view and top view of a power terminal module of the fourth embodiment of the present disclosure. Since the power terminal module of this embodiment is partially the same as the power terminal module of the first embodiment, the same symbols would be given to the same components and descriptions would be omitted. In this embodiment, the first end part 221 and the second end part 222 of the elastic terminal 22 are both disposed in the accommodating gap G between the first power terminal 211 and the second power terminal 212. A plurality of notches N is provided on a position of the second body 2121 of the first power terminal 211 corresponding to the elastic contacting part 223 of the elastic terminal 22, allowing the elastic contacting part 223 of the elastic terminal 22 to protrude in a direction toward the receiving slot 11 through the notch N.

Figure 12:
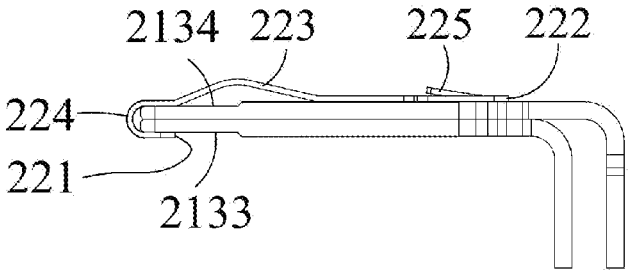
FIG. 12 is a side view of a power terminal module of the fifth embodiment of the present disclosure.

FIG. 12 is a side view of a power terminal module of the fifth embodiment of the present disclosure. Since the power terminal module of this embodiment is partially the same as the power terminal module of the first embodiment, the same symbols would be given to the same components and descriptions would be omitted. In this embodiment, the accommodating part 213 comprises a third recess 2133 disposed on an outer surface of the second power terminal 212. The first end part 221 of the elastic terminal 22 is disposed in the third recess 2133. In this embodiment, a fourth recess 2134 is disposed on an outer surface of the first power terminal 211 away from the second terminal. The third recess 2133 is opposite to the fourth recess 2134. The bent part 224 of the elastic terminal 22 surrounds a front end of the first power terminal 211 and the second power terminal 212. Since the rest parts of the embodiments are identical to the first embodiment, the related description would not be repeated herein.

Figure 13:
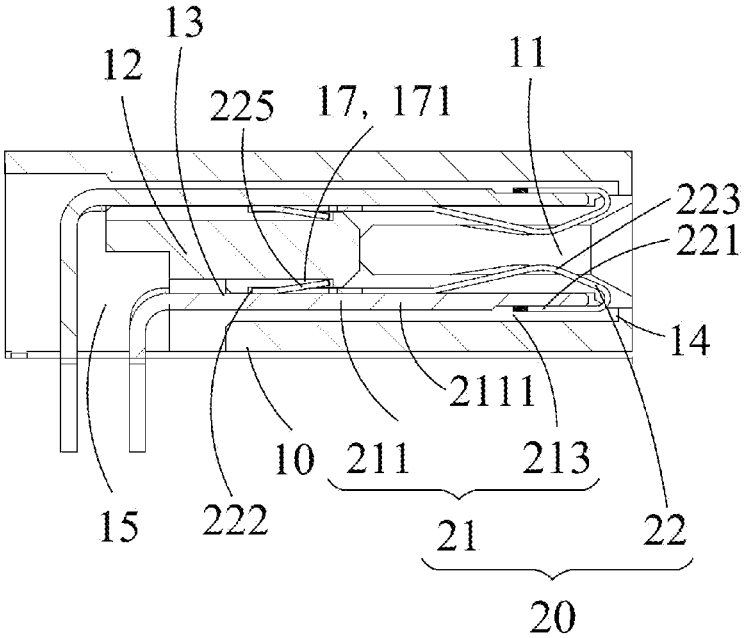
FIG. 13 is a cross-sectional view of an electrical connector of the sixth embodiment of the present disclosure.

It should be understood that, in some embodiments, the second power terminal is not necessary to be provided to a connector according to different requirements on electric current, and only by stacking the first power terminal with the elastic terminal to achieve electric power transmission. FIG. 13 is a cross-sectional view of an electrical connector of the sixth embodiment of the present disclosure. Since the electrical connector of this embodiment is the same as the rest parts other than the second power terminal of the electrical connector of the first embodiment, the same symbols would be given to the same components and descriptions would be omitted. The electrical connector of this embodiment comprises two first power terminals 211 which are oppositely disposed on the insulating body 10. The two first power terminals 211 are adjacent to a slot wall of the insulating body 10 respectively. The electrical connector of this embodiment further comprises two elastic terminals 22, which are respectively disposed on the first power terminals 211 in a one-to-one correspondence, respectively. Each elastic terminal 22 comprises a plurality of elastic contacting parts 223 exposed in the receiving slot 11. The elastic terminal 22 further comprises a first end part 221 and a second end part 222. Two ends of the elastic contacting part 223 are connected to the first end part 221 and the second end part 222, so that the elastic contacting part 223 is disposed between the first end part 221 and the second end part 222. The elastic terminal 22 is bent around a front end of the first power terminal 211 so that the first end part 221 and the second end part 222 are respectively disposed on different surfaces of the first power terminal 211. In this embodiment, the first end part 221 and the second end part 222 are respectively disposed on opposite two surfaces of the first power terminal 211. The second end part 222 is closer than the first end part 221 to the slot wall of the receiving slot 11 of the insulating body 10. The plurality of elastic contacting parts 223 and the second end part 222 are disposed on the same surface of the first power terminal 211. The first end part 221 is in contact with the first power terminal 211. The first power terminal 211 comprises a flat first body 2111. The plurality of elastic contacting parts 223 is disposed corresponding to the first body 2111.

In summary, the electrical connector of this disclosure could have a greater deformation tolerance than that in the prior art by the elastic terminal disposed in the accommodating part to ensure that the elastic contacting part comprises a good contact with the mating electrical connector. Thus, high-current transmission can be ensured.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

an insulating body comprising opposite two slot walls and a receiving slot disposed between the two slot walls;

at least one power terminal module disposed on the insulating body, the at least one power terminal module comprising:

a power terminal set disposed on the insulating body, the power terminal set comprising a first power terminal, a second power terminal and an accommodating part being overlappingly stacked, the second power terminal being closer than the first power terminal to the slot wall adjacent to the power terminal set, an elastic terminal disposed in the power terminal set, exposing in the receiving slot, the elastic terminal comprising a first end part, a second end part, and a plurality of elastic contacting parts disposed between the first end part and the second end part, the first end part being disposed in the accommodating part, and wherein the insulating body comprises a tongue member disposed in the receiving slot; the first power terminal is closer than the second power terminal to the tongue member; the tongue member comprises a positioning component on which the second end part is positioned.

2. The electrical connector according to claim 1, wherein the accommodating part is disposed between the first power terminal and the second power terminal; the first end part is disposed in the accommodating part; the plurality of elastic contacting parts and the second end part are disposed on an outer surface of the first power terminal.

3. The electrical connector according to claim 2, wherein the accommodating part comprises a first recess and a second recess; the first recess is disposed on a surface of the first power terminal opposite to the second power terminal; the second recess is disposed on a surface of the second power terminal opposite to the first power terminal.

4. The electrical connector according to claim 2, wherein the accommodating part comprises an accommodating gap in which the first end part is disposed.

5. The electrical connector according to claim 4, wherein the first end part comprises an elastic abutting bump abutting against one of the first power terminal and the second power terminal.

6. The electrical connector according to claim 2, wherein the accommodating part comprises an accommodating gap and a plurality of notches; the accommodating gap is between the first power terminal and the second power terminal; the plurality of notches are disposed on the first power terminal at intervals; the elastic terminal is disposed in the accommodating gap; the plurality of elastic contacting parts respectively pass through the plurality of notches.

7. The electrical connector according to claim 1, wherein the accommodating part is disposed on an outer surface of the second power terminal away from the first power terminal; the first end part is disposed in the accommodating part; the plurality of elastic contacting parts and the plurality of second end parts are disposed on an outer surface of the first power terminal away from the second power terminal.

8. The electrical connector according to claim 7, wherein the accommodating part comprises a third recess disposed on an outer surface of the second power terminal away from the first power terminal; the first end part is disposed in the third recess.

9. The electrical connector according to claim 1, wherein the positioning component comprising a positioning recess disposed on the tongue member; the second end part is disposed in the positioning recess.

10. The electrical connector according to claim 9, wherein the elastic terminal comprises at least one elastic tab disposed on the second end part; the at least one elastic tab abuts against the positioning recess.

11. The connector according to claim 1, wherein the first power terminal comprises a first body and a plurality of first weld legs extending from the first body; the opposite two ends of the first body are respectively provided with the accommodating part and the plurality of first weld legs.

12. The connector according to claim 1, wherein the first power terminal comprises a first body comprising a plurality of first barbs; the plurality of first barbs disposed on opposite two sides of the first body is interferingly fitted to the insulating body.

13. The connector according to claim 1, wherein the first power terminal comprises a flat first body in which the accommodating part is disposed.

14. An electrical connector, comprising:

an insulating body comprising opposite two slot walls and a receiving slot disposed between the two slot walls;

two first power terminals oppositely disposed on the insulating body, respectively adjacent to each slot wall; and two elastic terminals correspondingly disposed on the first power terminals in an one-to-one correspondence, respectively; each elastic terminal comprises a plurality of elastic contacting parts exposed in the receiving slot;

wherein the elastic terminal further comprises a first end part and a second end part connected to the plurality of elastic contacting parts; the plurality of elastic contacting parts is disposed between the first end part and the second end part; and the elastic terminal is bent around a front end of the first power terminal such that the first end part and the second end part are respectively disposed on different surfaces of the first power terminal.

15. The electrical connector according to claim 14, wherein the plurality of elastic contacting parts and the second end part are disposed on a same surface of the first power terminal; the first end part is in contact with the first power terminal.

16. The electrical connector according to claim 14, wherein the first power terminal comprises a flat first body; the plurality of elastic contacting parts is disposed corresponding to the first body.

* * * * *